United States Patent [19]

Hamelin et al.

[11] 4,301,922

[45] Nov. 24, 1981

[54] PACKAGE WITH SURROUNDING BINDER

[75] Inventors: Benoit Hamelin, Schiltigheim; Brigitte Constant, Selestat, both of France

[73] Assignee: Brasseries Kronenbourg, Cronenbourg, France

[21] Appl. No.: 70,928

[22] Filed: Aug. 30, 1979

[30] Foreign Application Priority Data

Sep. 1, 1978 [FR] France ..... 78 25707
Jan. 8, 1979 [FR] France ..... 79 00692

[51] Int. Cl.[3] ..... B65D 65/00
[52] U.S. Cl. ..... 206/428; 206/597; 206/815; 229/52 AC; 229/52 BC
[58] Field of Search ..... 206/428, 597, 815; 229/52 AC, 52 AL, DIG. 8, 52 AW, 52 BC

[56] References Cited

U.S. PATENT DOCUMENTS 2,365,887 12/1944 Lind ..... 229/DIG. 8
3,065,845 11/1962 Nichols ..... 229/52 AL
3,618,759 11/1971 Kolasinski ..... 229/52 AL
4,158,410 6/1979 Novatny ..... 206/597

*Primary Examiner*—Joseph Man-Fu Moy
*Attorney, Agent, or Firm*—Prutzman, Kalb, Chilton & Alix

[57] ABSTRACT

A cardboard package for a group of bottles or any containers of a generally cylindrical shape has a flat binder encircling its lateral surfaces. The binder is held in the plane of equilibrium of the full package by deformable structures on each of the corners of the lateral surfaces.

When the binder is pulled the deformable structures collapse thus reducing the periphery of the package and the excess loop of the binder can be used as a handle.

15 Claims, 23 Drawing Figures

PACKAGE WITH SURROUNDING BINDER

PACKAGE WITH SURROUNDING BINDER

BACKGROUND OF THE INVENTION

The invention concerns an improved package typically of cardboard, for the presentation for sale, handling, manipulation and transport, especially by the consumer, of a group of receptacles containing any product and especially a high consumption product, these receptacles being of a generally cylindrical shape, for example bottles of beer.

In hypermarkets, there is a very sharp increase in the capacity of packages for drinks in small bottles. After the appearance of cardboard packages of six bottles, now traditional in more or less sophisticated shapes and sizes, the number rose to eight then ten, and even twelve, and now twenty-four in the case of bottles of 25 cl. Such a quantity bought at any one time seems large for the average consumer; however, studies show a clear evolution of the market in this direction. Currently, for presenting these quantities to the consumer, no use is made of the conventional factory cardboard boxes such as that used for the sale of twelve or more plastic bottles of mineral water. Moreover, the market does not have any cardboard "packs" capable of resisting by their structure alone the mechanical stresses of handling imposed by the weight of such a grouping of twenty-four units (10 kg and more).

Consequently, there has been proposed and utilized a mixed technique which consists in placing a group of bottles side by side on a flat base of the boat-shaped type.

The whole is enveloped in a film of synthetic thermoplastic material which assures the maintenance and cohesion of the bottles. However, besides the purely commercial and advertising inconveniences (lack of personalisation of the whole product), there is a total absence of gripping elements.

To these difficult inconveniences of handling and carriage, which are all the more annoying in proportion as the weight increases, especially for a woman, there is added a total lack of stability of the bottles as soon as the package is opened and its contents broken into. Besides, this type of pack is in no way adapted for gripping with one hand alone. Finally, when the film is taken off, the boat-shaped base becomes totally useless as a container, for example for the return of empties or collecting them with a view to recycling.

It has also been suggested, for the transport of bottles, to use ordinary cardboard packages, of the American box or tray type, having at the four corners large holes allowing the passing through of a strap which grips the bottles tightly against each other. Such rather heavy packages are very difficult to manipulate for the consumer, who has no handle to grasp and carry them with.

SUMMARY OF THE INVENTION

The package which is the subject of the present invention does not entail the inconveniences of the techniques used hitherto and offers, by contrast, substantial advantages amongst which the following will be noted:

- it allows a large number of receptacles to be packaged, especially bottles, for example 24, while at the same time being manufactured out of a cardboard blank of small thickness, and thus being inexpensive;

- it makes a package easy to manipulate and transport, and that in total safety, not only for the manufacturers and sellers, but also for the consumer;
- it can be used for the manipulation and transport not only of full containers but also of empty containers, whether they are stored or sold as waste packaging and recovered (recycled glass);
- it is advantageously used as an advertising support.

The package according to the present invention aims at completely resolving the difficulties of handling and carriage encountered by the consumer in the case of an article coming in the category of objects estimated as being heavy for the average buyer.

A package according to the present invention has a body, in the general shape of a prallelepiped, manufactured from a cardboard blank. On one of its surfaces it includes means of access to its interior which are not destructive of the whole package, for example flaps on its upper face.

A flat binder encircles the package in a plane perpendicular to the generatrices of the containers transported in a horizontal position, and which passes through the centre of gravity of the package. This binder is kept, unfastened, in this plane by deformable receiving structures at, or on both sides of, at least one of the corners.

Pulling on this binder forms a handle on one or another or all of the lateral surfaces, at the choice of the consumer, by crushing the deformable structures.

In case of need the package may include means of immobilisation by closing the flaps of its front surface. These protect the contents of the package from light in the course of consumption, by keeping them in the closed position. They also ensure that the package closes at the time of returning the empties.

The invention will be better understood with the aid of the following description, given by way of example without limitation with reference to the accompanying drawings.

(b) the notch forming a slot with a smaller central cut-out;

(c) the notch forming a slot with a central slit

Figure 1:
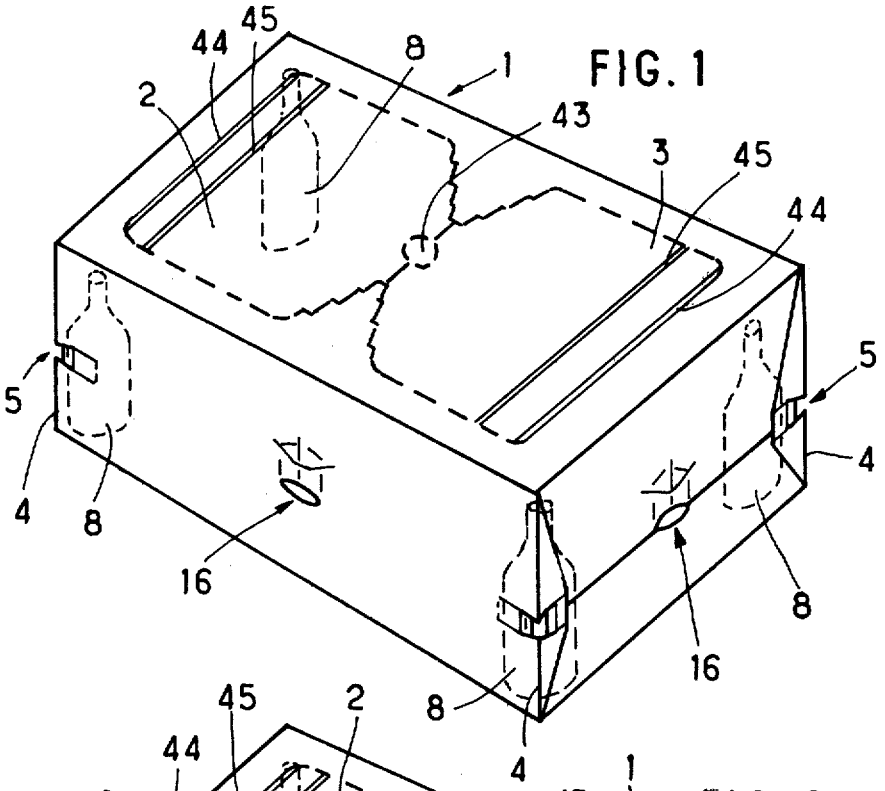
FIG. 1 is a perspective view of a package according to the invention, with the binder removed.
Figure 2:
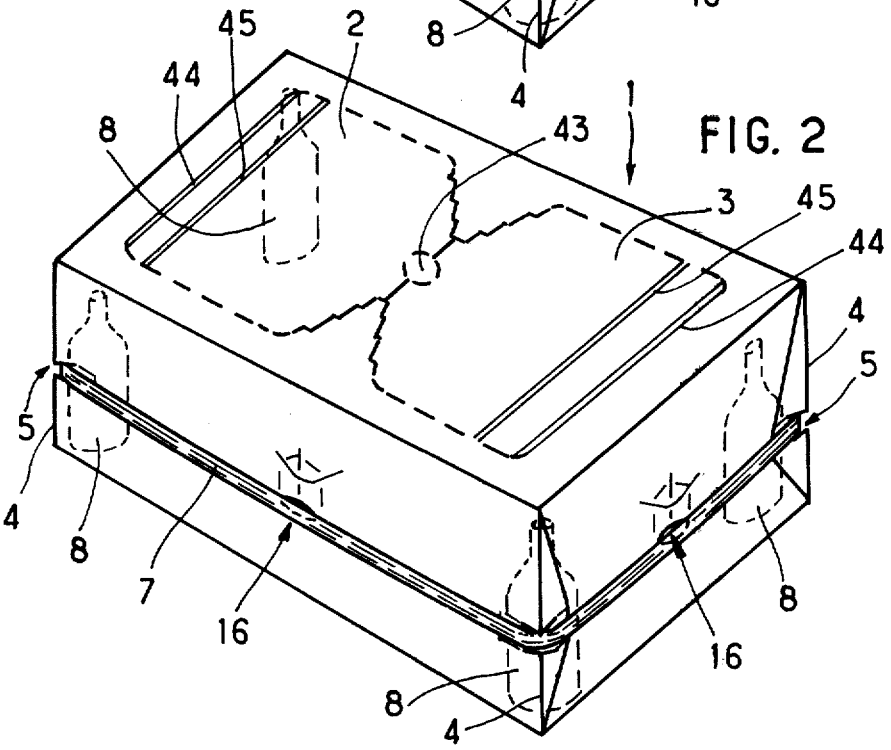
FIG. 2 is a perspective view of the package with its binder.
Figure 14:
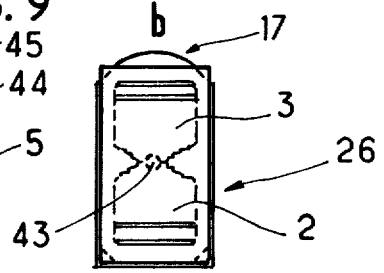
Figure 14:
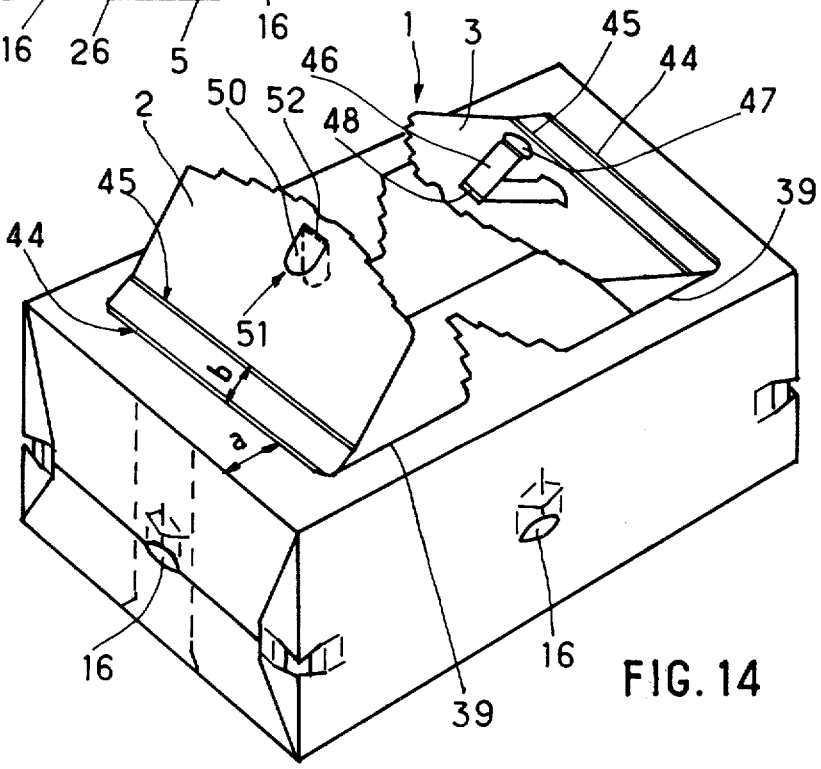
Figure 11:
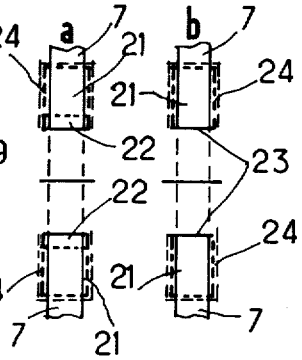
Figure 12:
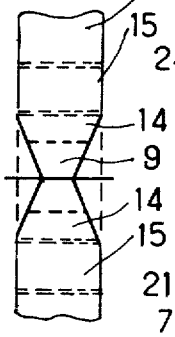
Figure 13:
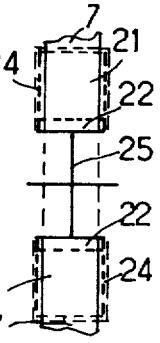
Figure 15:
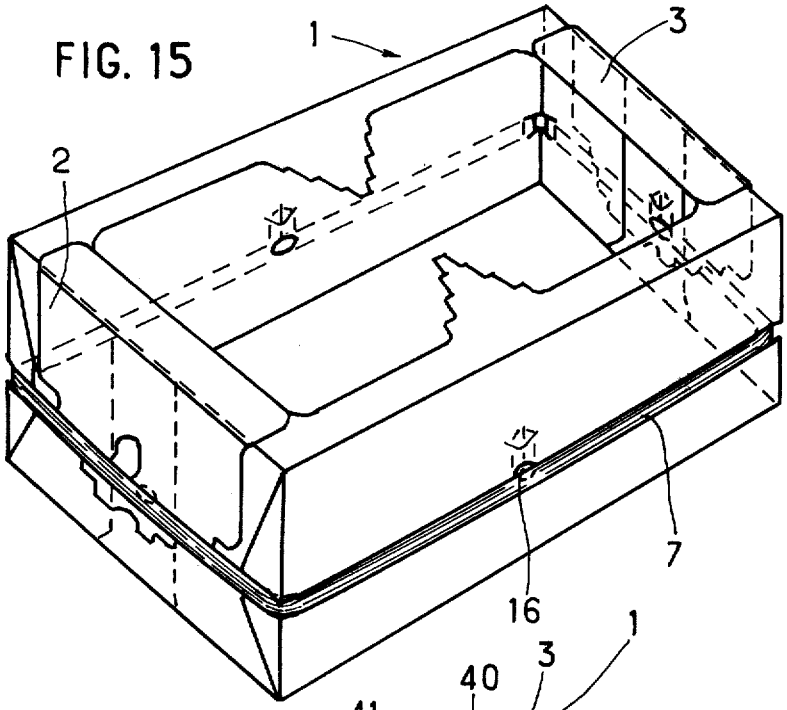
Figure 16:
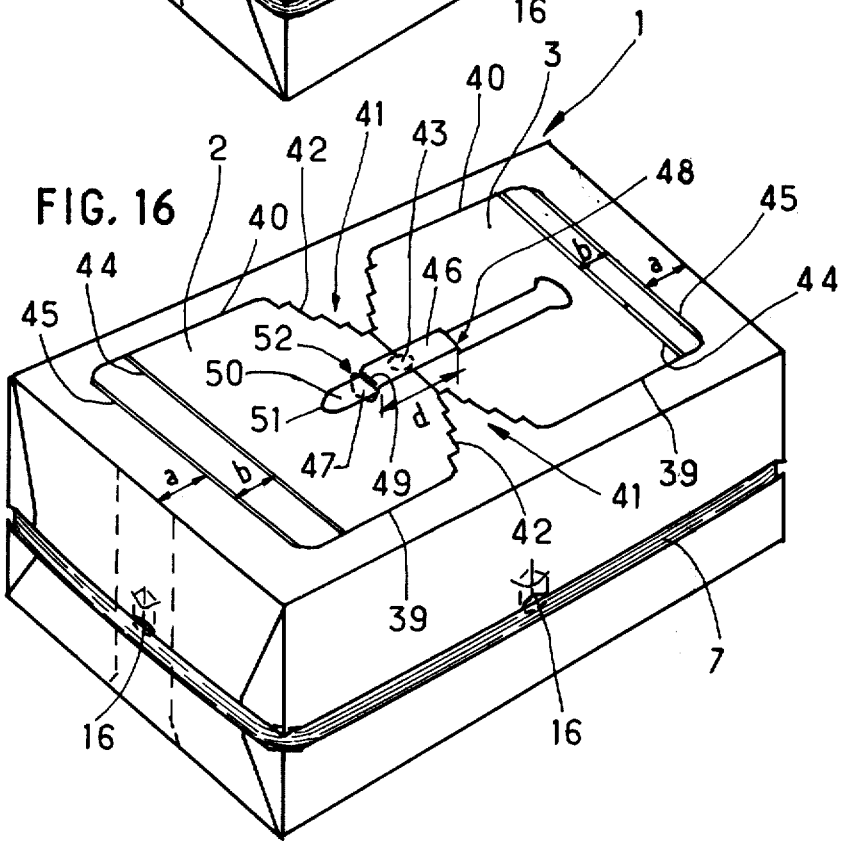
Figure 17:
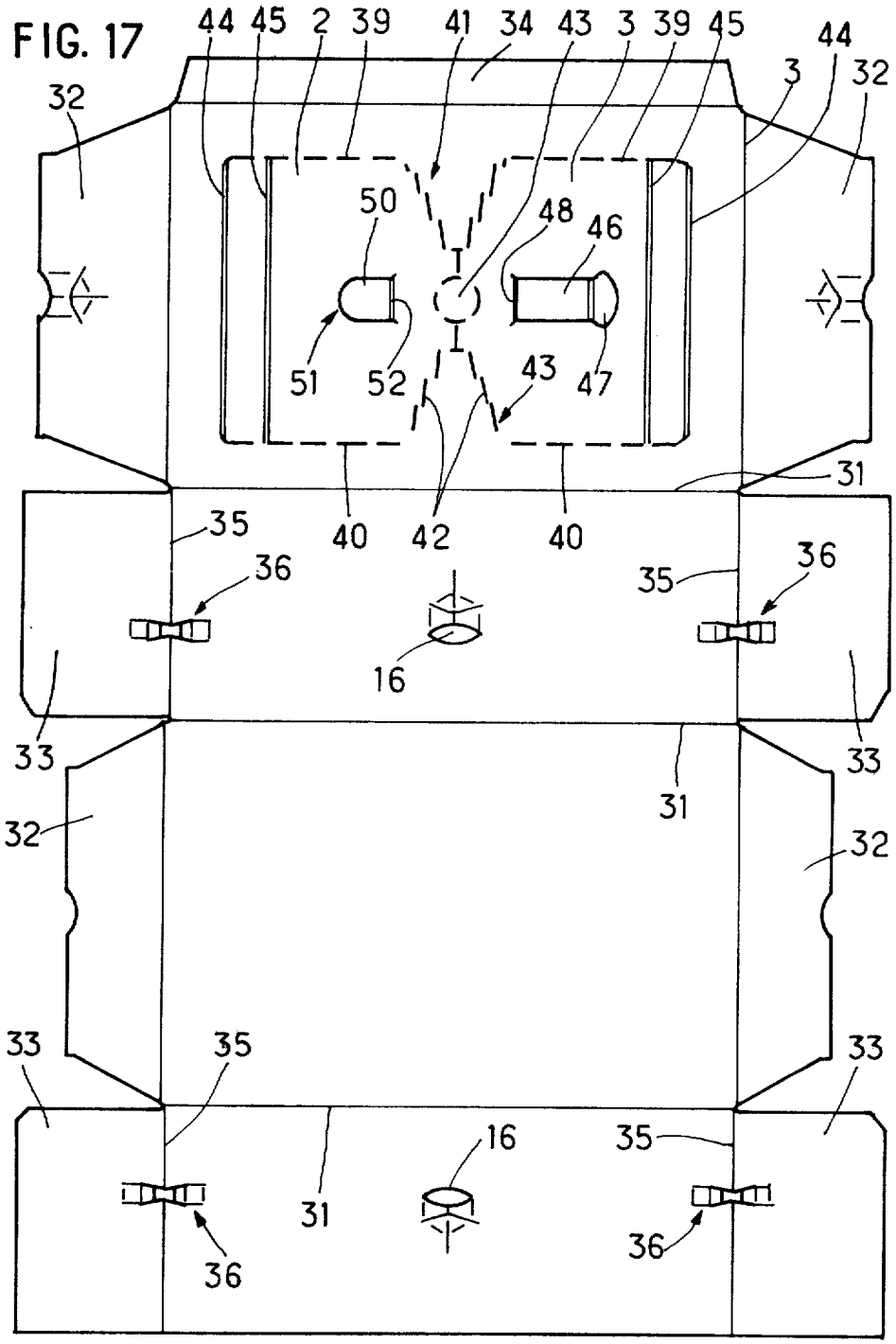
Figure 18:
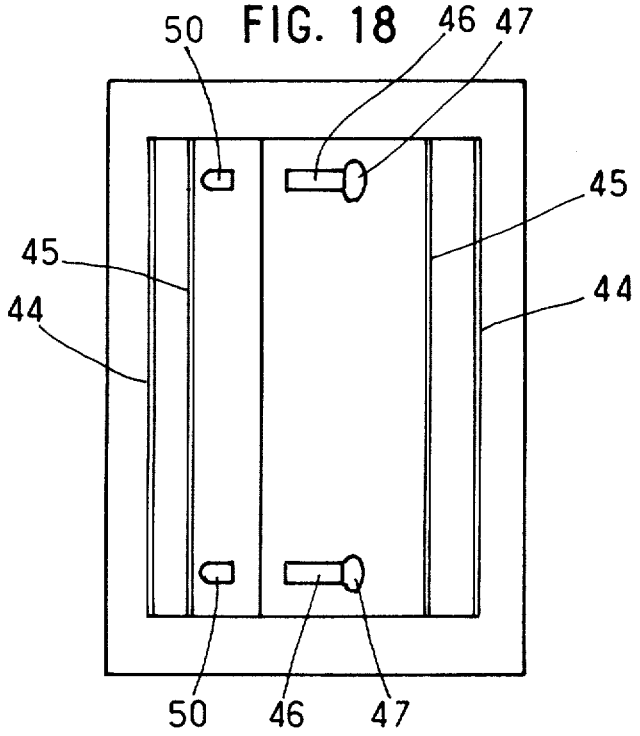
Figure 19:
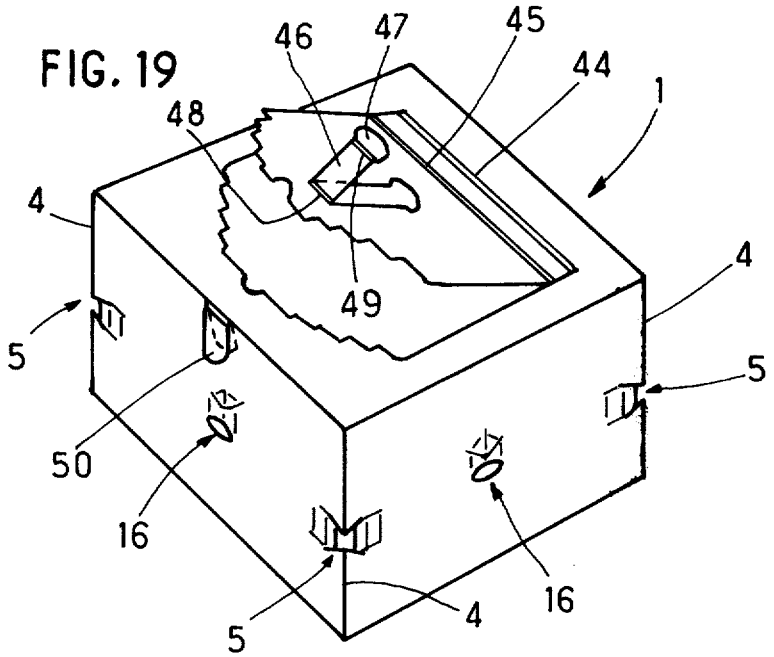

FIG. 11 is a plan view showing two variants of notches forming slots placed on both sides of a corner and passages under the corners;

(a) wide slits with parts cut out before hand in double dotted lines;

(b) thin slits of the button-hole type with parts cut out before hand in double dotted lines, (the binder is shown with fine dashes);

FIG. 12 shows a plan view of a notch forming a slot with triangular edges, such as that used in FIG. 1;

FIG. 13 shows a plan view of a notch forming a slot derived from those shown in FIG. 11 with a longitudinal incision for the passage of the binder under the box;

FIG. 14 shows in perspective a variant of the package illustrated in FIG. 1, including a locking mechanism formed in the flaps of its upper surface, with the binder taken off;

FIG. 15 shows the same package as FIG. 14 when pressed behind the binder and held by it in an open position;

FIG. 16 shows the same package as FIG. 14, with the flaps bolted, for the return of the empty containers (bottles);

FIG. 17 shows the package of FIG. 14 in plan view with its locking mechanism;

FIG. 18 shows a variant design in plan view with longitudinal flaps and a double locking mechanism;

FIG. 19 shows a perspective view of a variant with only one flap.

DETAILED DESCRIPTION

We will refer first of all to FIG. 1 which shows the most interesting method of production. The package shown in FIG. 1 consists of a body 1, preferably of cardboard, in the general shape of a parallelepiped, constructed from the cut out cardboard blank shown in FIGS. 7 and 17 of the classic "wrap around" type.

The invention applies equally well to other forms of box, in particular to the type of boxes called "American boxes".

The upper surface of the body of the package has two symmetrical flaps 2 and 3 cut out beforehand, in the general shape of a rectangle, forming trap-doors giving access to all the bottles since the length of the flaps and the position of their edges passes over the necks of the bottles of the outside rows.

These flaps have the characteristics examined below as well as, in appropriate cases, means of immobilising them in a firm position. First of all we will describe the essence of the invention, with reference to FIGS. 1 to 6.

Each of the corners 4 of the lateral surfaces of the package is interrupted at the level of its intersection with the perpendicular plane at the generatrices of the containers passing through the centre of gravity or plane of equilibrium of the masses, when the package is carried vertically, by a deformable receiving structure extending on both sides of the corner, for example a notch 5 forming a slot. These notches are generally made with a primary notch 6 prolonged by lines cut out beforehand which are represented by double dotted lines on the figures and which, by local depression on the box, allow us, as we shall see, to make a handle.

The receiving structures are used for the passage and lateral maintenance of a binder 7, preferably a plane binder for example of the supple ribbon type made of synthetic material girdling the bottles 7 on the outside of the box.

It is important to note that the length of this border is always greater than the perimeter of the group of bottles, and is determined in such a way as to effect a semi-fastened hooping at the time of putting on the binder by using only partially, or not at all, the possibilities of locally depressing the box at the level of the deformable structures.

The gripping loop serving as a handle will be made by the consumer himself, when shopping, as explained below.

Until manipulation by the consumer, the binder remains simply in contact with each surface. Thus one avoids untimely catching in the course of handling by preformed loops, and the cohesiveness of the packaging is increased in case of need (destruction or damaged cardboard box).

The notch forming a slot which seems most interesting is shown in FIGS. 3 to 6.

Figure 6:
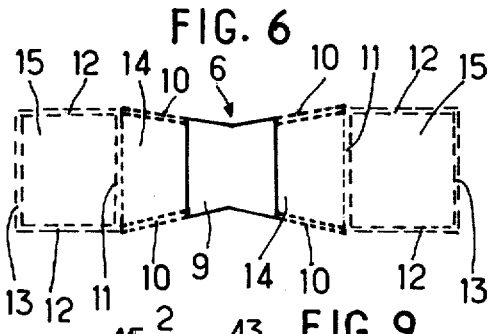
FIG. 6 is a detail view of a notch forming a slot, shown flat, parts cut out beforehand or the fold lines shown in double dotted lines.

In FIG. 6, the parts cut out beforehand or folds are shown by dotted lines. It comprises the primary notch 6 with slightly diverging sides formed by a central of substantially central cut-out 9, by two previously cut out parts such as 10 and a transverse fold 11. The previously cut out parts 10 are extended by previously cut out parts 12 which are, as a rule, connected at the ends by a second transverse fold 13.

The slightly trapezoidal perimeter forms the first flaps 14 extended by secondary flaps 15 delimited by the parts cut out beforehand 12 which yield to pressure and the transverse fold 13.

The notch described above presents a closed section. The width of the entrance of the notch is slightly less than the width of the binder 7, in such a way that the latter cannot come out of it when it becomes loose, while still being able to be inserted.

Figure 3:
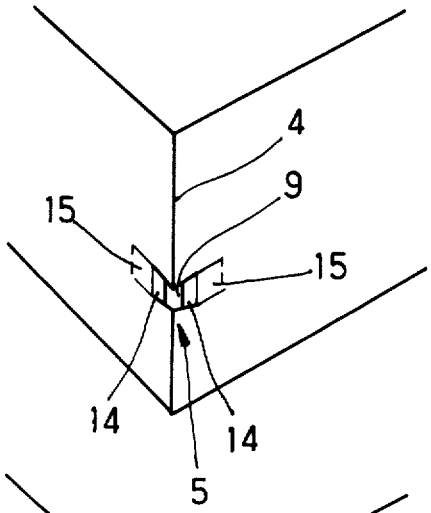
FIG. 3 is a perspective detail view of a notch forming a slot at a corner of a package showing the deformable structures before putting on the binder.
Figure 4:
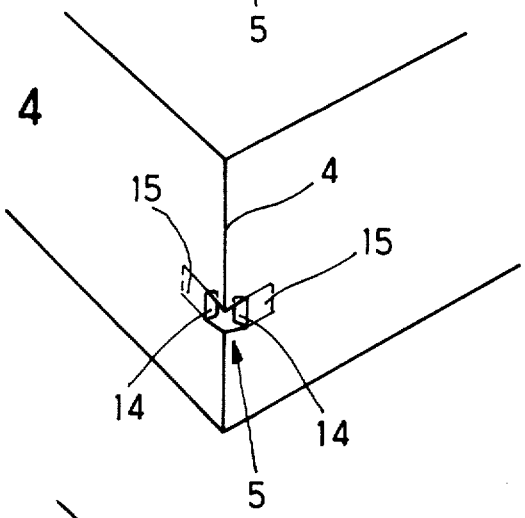
FIG. 4 is a perspective detail view of a notch forming a slot showing the deformable structures after placing the binder on the article.
Figure 5:
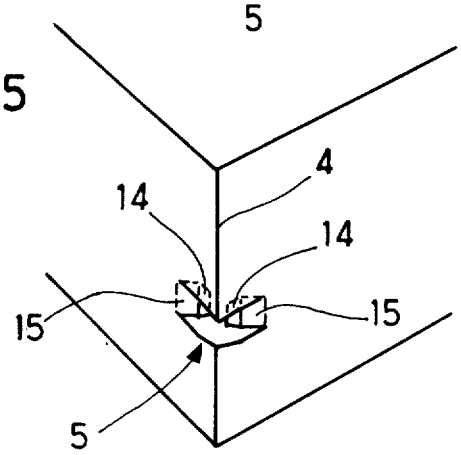
FIG. 5 is a perspective detail view of a notch forming a slot showing the deformable structures after the binder is pulled by the consumer.

Before putting on the binder in the factory, the first flaps 14 and the secondary ones 15 are not pressed down, for the parts cut out beforehand have not yet yielded (FIG. 3). When the binder is put on, the tension of fitting it forces it into the notch. The entry into the notch is effected by force and the first flaps 14 are detached and pressed down, playing the role of shock absorber (FIG. 4).

The same entry process is repeated on the four corners. The two ends of the binder are joined together. Then length of the binder is determined in such a way that it stays in simple contact, without tension, with the lateral surfaces.

At the time of sale in the shop, the buyer grasps the pack by the binder, pushing in the supplementary previously cut out parts 16 placed on each of the lateral surfaces. These help him, by the local giving way of the cardboard, to pass his fingers through to grasp the ribbon.

Of course, these previously cut out parts can take various forms corresponding to the best adapted versions.

The traction applied gives rise to a partial yielding of the previously cut out edges 10 of the first flaps 14 which come into contact with the body of the bottles in the corner 8 (FIG. 5) and thus artifically diminish the perimeter circumscribed and allow the disengagement of a loop sufficiently loose to serve as a handle 17 by forcing the binder to the bottom of the notches forming the slots. This loop, serving in the role of a handle, will, by the choice of ribbon, its width, its suppleness, etc present all the desired qualities of comfort.

Of course, all the variants of technical forms of notch are possible.

By way of example, some of them have been shown in FIGS. 10, 11, 12 and 13.

The variant shown in FIG. 12 is similar to the one described above with its two flaps, first and secondary 14 and 15, its oblique central edges which have been cut out beforehand 10, its central cut out part 9 and the previously cut out parts 12 delimiting the secondary flaps.

Figure 10:
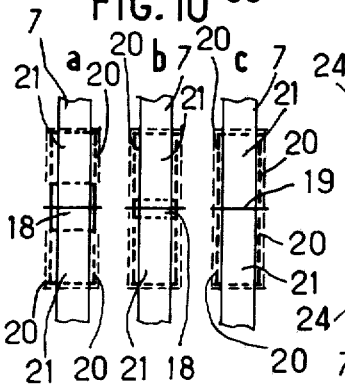
FIG. 10 is a plan view of three varieties of slot, the horizontal dash representing the corner, the fine vertical dashes the edges of the binder and the dotted dashes the parts cut out beforehand or the fold lines with (a) the notch forming a slot with a central cut-out.

In the notches forming slots shown in plan view in FIG. 10, the central cut out parts 18 corresponding to the primary notch have a diminished surface, to be reduced to a simple slit 19 in (c).

The double dotted lines 20 show the previously cut out parts which delimit the equivalent of the secondary flaps 21.

FIG. 11 shows a variant with slits 22 (a) or a simple cut-out 23 (b) of the button-hole type where the binder crosses the corners under the cardboard box. Here likewise the passages are connected to the equivalent of secondary flaps like 21 with previously cut edges 24.

Figure 8:
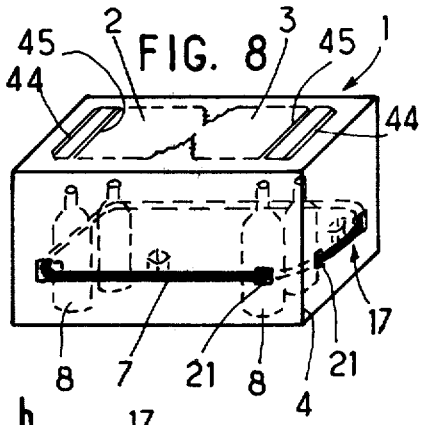
FIG. 8 is a perspective view of a variant form with deformable slits on both sides of the corners and passage of the binder through the corners.

This latter variant is applied in the packaging shown in FIG. 8 which proceeds from the same general principle of the invention while leaving intact the corners. This shows better the handle function. In practice, the placing of the binder during manufacture should leave intact the previously cut out parts 12,20 and 25 which the consumer will break by crushing them when pulling on the binder to make the handle.

Another way of producing the notches 5 forming slots is shown in FIG. 13. The slits 22 are connected together by a middle cut-out 25. This will allow the space between the slits to be opened in order to slip the binder in more easily.

Figure 9:
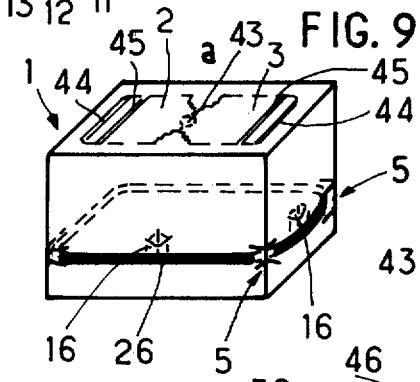
FIG. 9 is a double view (a) in perspective and (b) in plan of a variant form with an adhesive band.

Another variant of this package shown in FIG. 9(a) and (b) uses an adhesive band 26 glued onto the large lateral surfaces and when needed also onto one of the small lateral surfaces. The band is likewise glued onto the curve of the corners to form the handle which is disengaged by pulling.

We shall now describe a cut-out cardboard blank suitable for production of a package in accordance with the invention.

Figure 7:
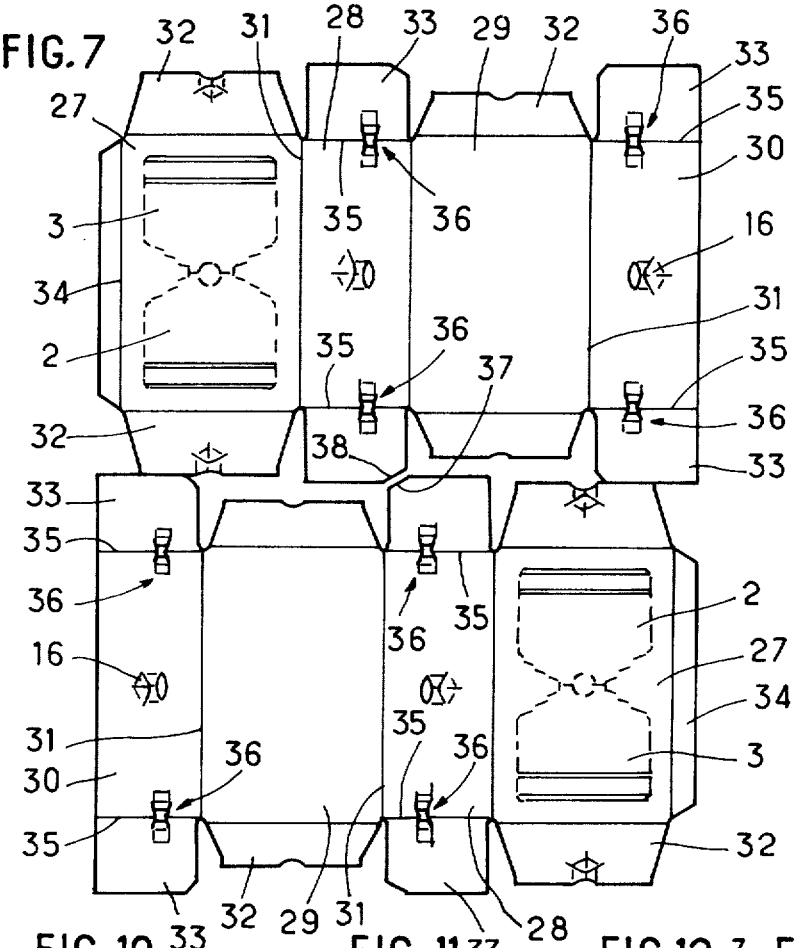
FIG. 7 is a plan view of two cardboard blanks placed side by side after simultaneous cutting out for making a package of the "wrap around" type shown in perspective by FIGS. 1 and 2.

For reasons of economy, two cardboard blanks are placed side by side and cut out simultaneously by one single machine pass as shown in FIG. 7.

The cardboard blank is formed of four planes 27, 28, 29 and 30, separated by folds such as 31, forming the surface of the package. Each surface is extended in the direction of its width by a trapezoidal, turned-down piece of small width 32 for the large surfaces 27 and 29 and rectangular ones to a greater width 33 for the small surfaces. The upper surface 27 includes in additional a longitudinal fastening flap 34.

The lateral folds 35 between the turned down pieces and the small surfaces have transverse pieces previously cut out 36 designed to make notches 5 forming slots on both sides of the corner, of which production examples have been given.

In the conventional fashion, the opposite corners of the turned down pieces in 37 and 38 are sliced off to gain width in order to place two cardboard blanks side by side on the same machine width.

The upper surface 27 has the two previously cut out flaps 2 and 3. These flaps comprise straight parts cut out beforehand 39 and 40 according to each one of their longitudinal sides. They have a third side such as 41 in a splayed V formed of a succession of previously cut out segments such as 42 staggered laterally and angularly.

The tops of the opposite sides 41 are joined at the centre of the upper surface by a previously cut out circular piece 43 which yields under the pressure of the finger when first opened. It facilitates the opening of the flaps.

The transverse edge opposite each flap forms a hinge for articulating by its double-grooved fold 44 situation at a distance a (FIGS. 14,15 and 16) of the adjacent transverse edge of the packaging (FIGS. 1,2,14,15,16). Each flap has in addition a second fold 45 parallel to the first situated at a distance b very slightly bigger than a of the first one.

This second fold allows the complete folding back of the flap around the angle formed by the adjacent planes on the neighbouring corner parallel to the fold in which the two planes of the flap come into contact with the said adjacent surfaces. The flap is immobilised in this position by being passed under the binder as shown in FIG. 15.

The flaps 2 and 3 of the upper surface can include in a particular form of production an original device for immobilisation a locking mechanism (FIGS. 14,16,17,18 and 19).

It is a question of two twin members cooperating to ensure the efficient closure of the package containing the empty bottles for their return or the recovery of the glass.

These members are in the form of a little flap or small tongue 46 provided by cutting out before hand its contours in any one of the flaps, for example in flap 3 in the middle part and in the longitudinal direction. It assumes a generally rectangular shape with the axis parallel for example to the edges of the upper surface 27 with the end 47 splayed for example in a mushroom shape as shown in the drawings as seen from the side of the articulation of the flap.

It includes at its base a transverse groove forming a fold 48 allowing it to pivot with relation to the plane of the flap in the opposite direction to the opening of the flap. A second transverse fold 49 exists at the base of the end 47 at a distance d from the first.

The other flap presents within reach of the small tongue a rectangular cut out piece 50 of the same width as the said small tongue, with a curvilinear end 51, for example, semicircular and pivoting around its base on a transverse line of folding 52 situated at the distance d from the base fold 48 in such a way that the lines of folding 49 and 52 are superimposed. The cut-out part 50 is removed by pressure, leaving an opening corresponding to its contours.

Keeping the flaps shut after consumption is effected in the following way: the body of the small tongue or little flap 46 pivots around its base to come down against the upper surface of the flap 2. The end 47 of the said small tongue is fitted into the opening 50 which is immobilised by the play of the differences in width.

An immobilising bolt is thus made for the two opening flaps of the front surface.

FIG. 18 shows a variant whose flaps arranged longitudinally open laterally in the manner of a package of the "American box" type. It includes two of the locking mechanisms described above and formed by the connection of a little flap or small tongue pivoting at the splayed end and by a nick cut out of the other flap.

The flaps can be identical or asymmetric.

The choice of one or the other variant is dictated by the following data:, height, shape and number of the bottles.

Their shape and height determine the position of the plane of centre of gravity, hence that of the flat binder, while the number imposes the position of the bolt unit or units, that is to say, of the cut out parts or previously cut out nicks 50, it being understood that for comfortable use, the said nick must be between the necks of the bottles.

The variant with asymmetric flaps will generally be preferred in the particular case of thinner bottles, with long necks and unequal numbers. In the case of smaller volume packages, for example twelve bottles, the variant shown in FIG. 19 will be adopted.

The distance d existing between the base of the small tongue 46 and its end 47 always corresponds to the length of the turned down piece.

The cut out bit 50 is made by extending the small tongue 46 in the lateral adjacent surface from the upper edge, the said edge coinciding with the line of articulation 52 of this cut out part.

In this way, a bolted closure is produced on one of the lateral surfaces.

We have only described above the principal variants or methods of production of the invention. Naturally other variants deriving directly from those described enter into the framework of the present invention, particularly in the case of cut out parts, notches, slits and other provided at the level of the corners as well as of the bolt unit of the flaps.

What is claimed is:

1. In a package for containers of generally cylindrical shape, the package being of generally parallelpiped shape and formed from a blank sheet of material, one surface of the package having non-destructive means of access to the interior of the package, the package having an encircling binder around its lateral surfaces, the binder lying on a plane perpendicular to the axes of the containers and passing through the center of gravity on the package when full, the binder being held in position by a deformable re-receiving structure adjacent at least one corner of the package, the improvement wherein said deformable receiving structure defines a binder receiving notch that includes a primary notch-forming portion and a supplementary notch-extending portion adjacent to and extending from said primary portion with said plane, said primary portion defining a first notch length with said binder defining a first package perimeter and said supplementary portion being deformable to move said primary portion to a displaced position and increase the length of the notch as said binder diminishes the package perimeter engaged by the binder to form a handle for carrying the package.

2. Package according to claim 1, wherein the binder is a flexible ribbon.

3. Package according to claim 1, wherein the deformable notch-forming portions are connected and precut to permit displacement upon pulling on the binder.

4. Package according to claim 3, wherein pulling at the time of putting on the binder provokes a rupture of the primary precut portion to form said first notch length.

5. Package according to claim 4, wherein pulling by the consumer translates into the formation of the handle.

6. Package according to claim 1, wherein the notches are centred on the corner and are extended on both sides by previously cut out primary and supplementary portions generally perpendicular to the corner and yielding under the effect of pulling on the binder.

7. Package according to claim 1, wherein the width of the notch forming the slot is less than the width of the binder.

8. Package according to claim 3, wherein the two longitudinal edges of the notch formed by the primary portions are extended by parallel precut lines separated by a distance slightly less than the width of the binder and the edges have in their middles two opposite points, centred on the corner, and forming a constriction which prevents the binder from coming out of the notches, even when it is loose.

9. Package according to claim 1, wherein the receiving structures are formed by primary notch-forming portions on both sides of the same corner, the primary portions being connected to previously cut out supplementary portions generally perpendicular to the corner.

10. Package according to claim 9, wherein the primary portions have the shape of slits parallel to the same corner and extended laterally generally perpendicular to the corner.

11. Package according to claim 10, wherein the slit is reduced to a simple cut out part through which the binder passes.

12. Package according to claim 9, wherein the primary portions are connected by a cut out in the middle of the primary portions.

13. Package according to claim 1, wherein at least one of the lateral surfaces encircled by the binder includes a cut out depressable portion which can be pressed down in the empty space located between the containers in order to facilitate the passage of the finger or fingers behind the binder with a view to the traction on the latter which will allow the handle to be formed.

14. Package according to claim 1, wherein the flat binder is glued onto the large lateral surfaces.

15. Package according to claim 14, wherein the binder is an adhesive band glued onto at least one of the large lateral surfaces.

* * * * *